US005357307A

United States Patent [19]

Glanville et al.

[11] Patent Number: 5,357,307

[45] Date of Patent: Oct. 18, 1994

[54] APPARATUS FOR PROCESSING PHOTOSENSITIVE MATERIAL

[75] Inventors: Thomas W. Glanville, Churchville; Douglas O. Hall, Canandaigua; Jan M. Munson, Ontario; Bruce R. Muller, Rochester; David G. Sherburne, Ontario, all of N.Y.

[73] Assignee: Eastman Kodak Company, Rochester, N.Y.

[21] Appl. No.: 981,687

[22] Filed: Nov. 25, 1992

[51] Int. Cl.[5] ..... G03D 3/02; G03D 13/02

[52] U.S. Cl. ..... 354/324; 354/331; 354/336

[58] Field of Search ..... 354/319–324, 354/331, 336, 339, 335, 340

[56] References Cited

U.S. PATENT DOCUMENTS

| | | | |
|---|---|---|---|
| 3,062,123 | 11/1962 | Limberger | 95/89 |
| 3,610,131 | 10/1971 | Frick et al. | 95/94 |
| 3,641,911 | 2/1972 | Aelterman et al. | 95/94 R |
| 3,688,677 | 9/1972 | Frick et al. | 354/319 |
| 4,023,190 | 5/1977 | Fassler | 354/319 |
| 4,327,988 | 5/1982 | Vanhorebeck et al. | 354/320 |
| 4,334,758 | 6/1982 | Leveille | 354/319 |
| 4,647,173 | 3/1987 | Schär | 354/319 |
| 4,678,310 | 7/1987 | Heist et al. | 354/319 |
| 4,758,857 | 7/1988 | Tanaka | 354/320 |
| 4,954,838 | 9/1990 | Nakamura et al. | 354/320 |
| 4,987,438 | 1/1991 | Goto et al. | 354/319 |
| 4,989,028 | 1/1991 | Hall et al. | 354/324 |
| 4,994,840 | 2/1991 | Hall et al. | 354/324 |
| 5,059,997 | 10/1991 | Hall et al. | 354/324 |
| 5,148,206 | 9/1992 | Shidara | 354/322 |

*Primary Examiner*—D. Rutledge
*Attorney, Agent, or Firm*—Dana M. Schmidt

[57] ABSTRACT

An apparatus for processing photosensitive material. The apparatus includes a processing chamber having an entrance and an exit for allowing a photosensitive material to travel through the processing chamber. A first supply means is provided for supplying processing fluid to the processing chamber to create a first fluid layer on one side of the photosensitive material and a first drain for removing processing fluid from the first fluid layer. A second supply means is provided for supplying processing fluid to the processing chamber to create a second fluid layer on the opposite side of the photosensitive material and a second drain for removing processing fluid from the second fluid layer. Means are provided for minimizing oxidation of the processing solution.

22 Claims, 8 Drawing Sheets

APPARATUS FOR PROCESSING PHOTOSENSITIVE MATERIAL

FIELD OF THE INVENTION

The present invention relates to an apparatus for processing photosensitive materials, such as sheets of x-ray film.

BACKGROUND OF THE INVENTION

The present invention is directed to a processing apparatus of the type which includes an upper tank and a lower tank for holding processing fluid and a narrow processing chamber located between the tanks through which a sheet of photosensitive material is advanced by nip rollers placed at the entrance and exit of the chamber for processing of latent images on the material. Processing fluid is delivered to opposite sides of the photosensitive material from each of the tanks for forming a fluid layer on each side of the photosensitive material. A return drain is provided on each side of the photosensitive material for removing and returning the processing fluid to the sump tank. Example of such devices are illustrated in U.S. Pat. No. 4,989,028; U.S. Pat. No. 4,994,840; and U.S. Pat. No. 5,059,997. Such devices are often referred to as fluid suspension processors.

In fluid suspension processors of the prior art it is important that oxidation of the processing fluid not be excessive. Prior art fluid suspension processors have been found to be sensitive to excessive oxidation. As the film enters the processing chamber, excess processing fluid is directed back to nip rollers placed at the entrance and exit. This excess fluid contacts the pinch rollers causing the processing fluid to become turbulent in this area which results in excessive oxidation occurring to the processing solution.

The present invention is directed to solving the problems experienced in prior art fluid suspension processors by providing means for minimizing turbulent flow of the processing fluid in the processor, especially at the entrance and exit adjacent the nip rollers.

SUMMARY OF THE INVENTION

An apparatus for processing photosensitive material. The apparatus includes a processing chamber having an entrance and an exit for allowing a photosensitive material to travel through the processing chamber. A first supply means is provided for supplying processing fluid to the processing chamber to create a first fluid layer on one side of the photosensitive material and a first drain for removing processing fluid from the first fluid layer. A second supply means is provided for supplying processing fluid to the processing chamber to create a second fluid layer on the opposite side of the photosensitive material and a second drain for removing processing fluid from the second fluid layer. Means are provided for minimizing oxidation of the processing solution.

BRIEF DESCRIPTION OF THE DRAWINGS

In the Detailed Description of the Preferred Embodiment of the invention presented below, reference is made to the accompanied drawing, in which.

DETAILED DESCRIPTION OF THE PREFERRED EMBODIMENT

Figure 1:
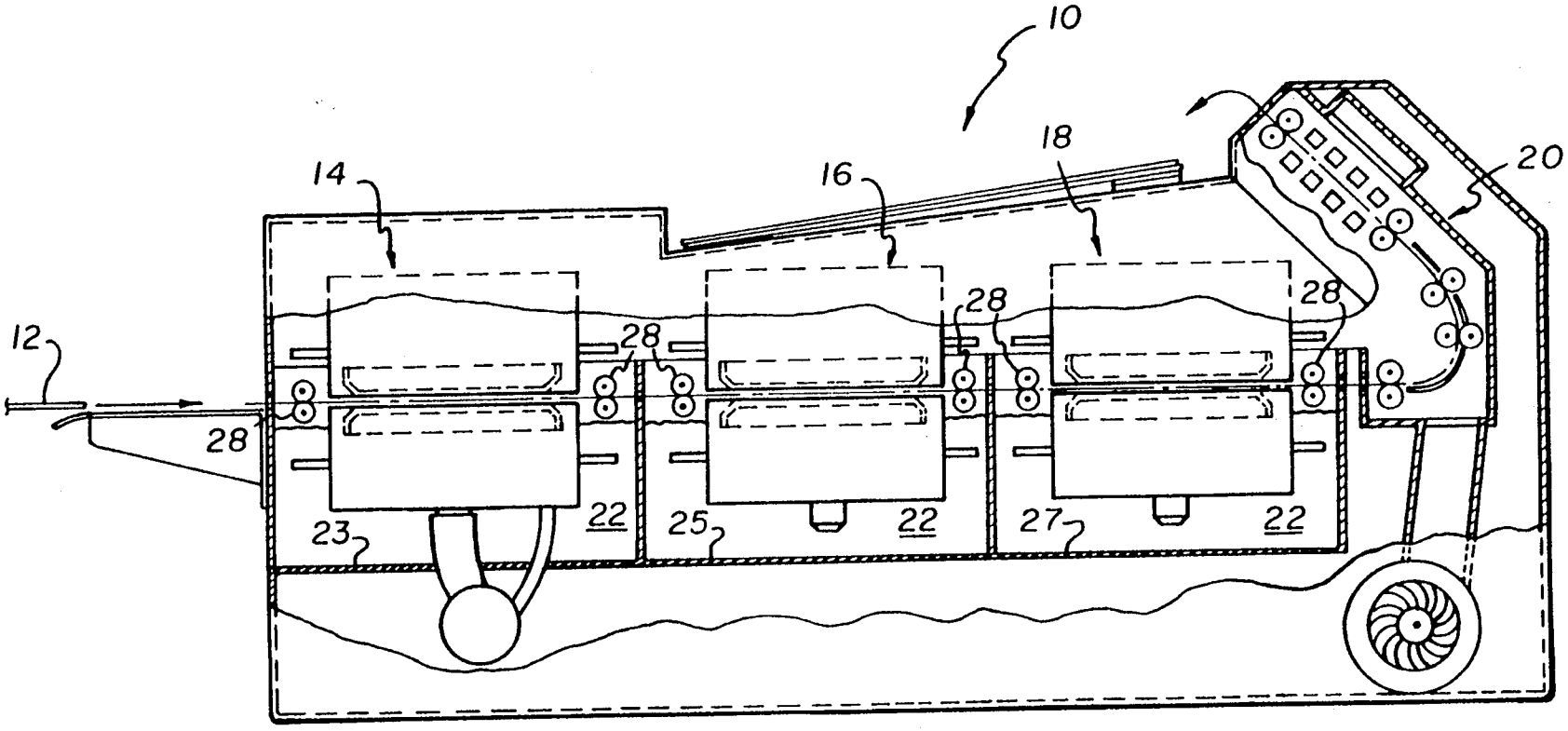
FIG. 1 is a cross-sectional view of a photographic processing apparatus made in accordance with the present invention.
Figure 2:
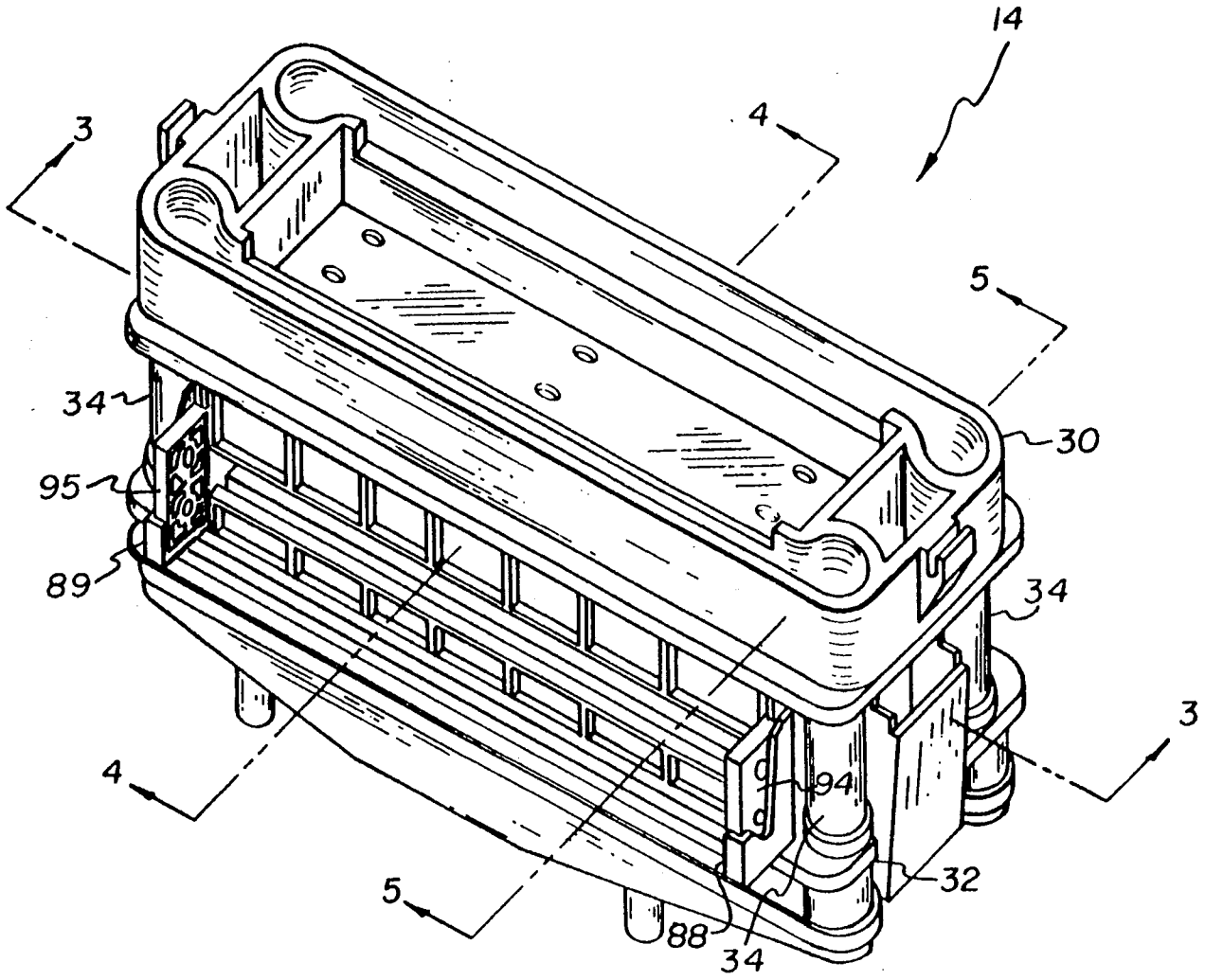
FIG. 2 is perspective view of one of the processing units of the processing apparatus of FIG. 1.
Figure 3:
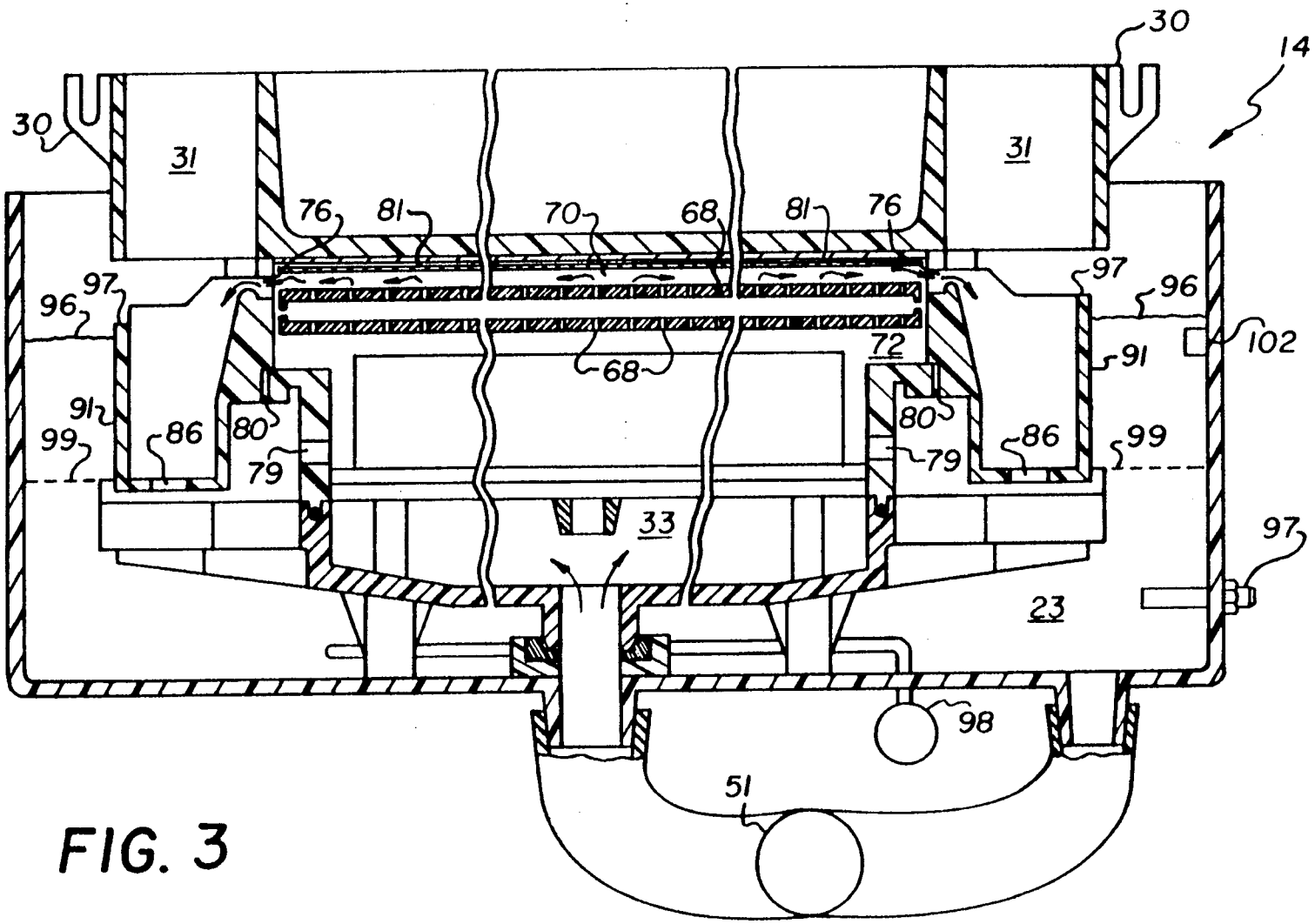
FIG. 3 is a cross-sectional view of the processing unit of FIG. 2 taken along line 3—3.
Figure 4:
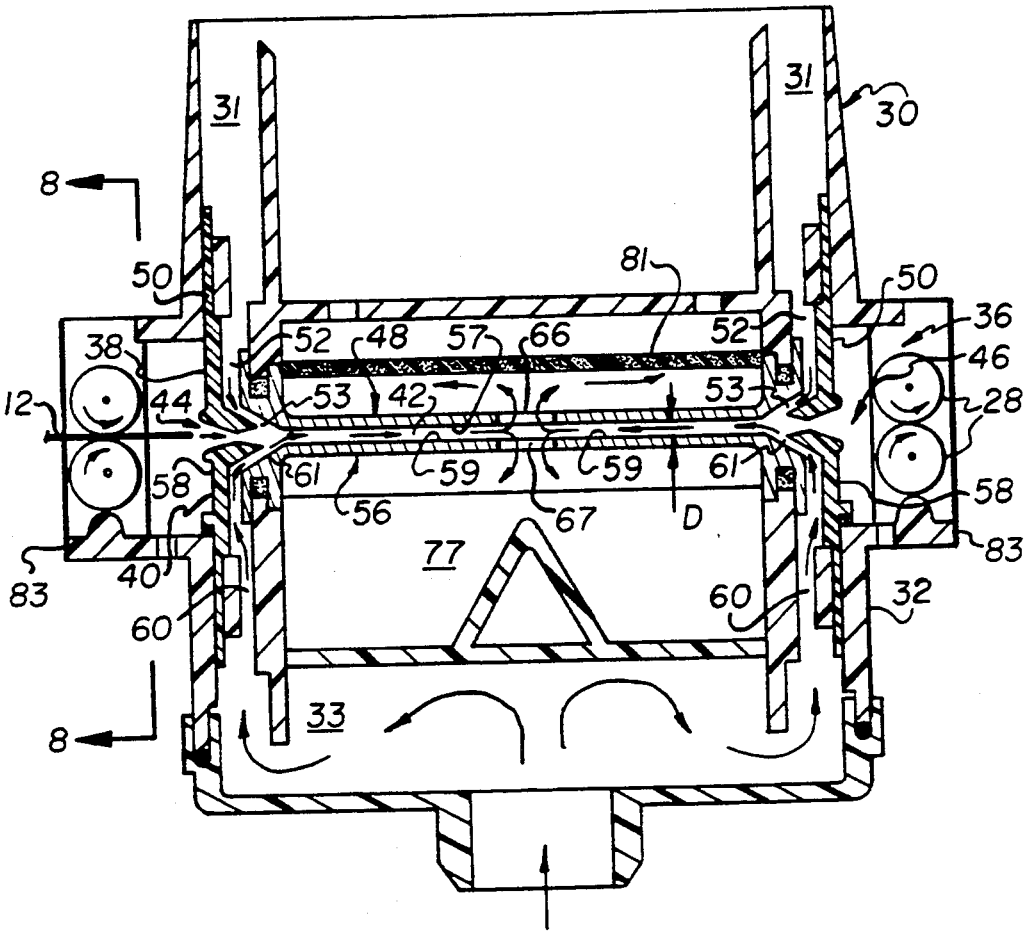
FIG. 4 is a cross-sectional view of processing unit of FIG. 2 as taken along line 4—4.
Figure 5:
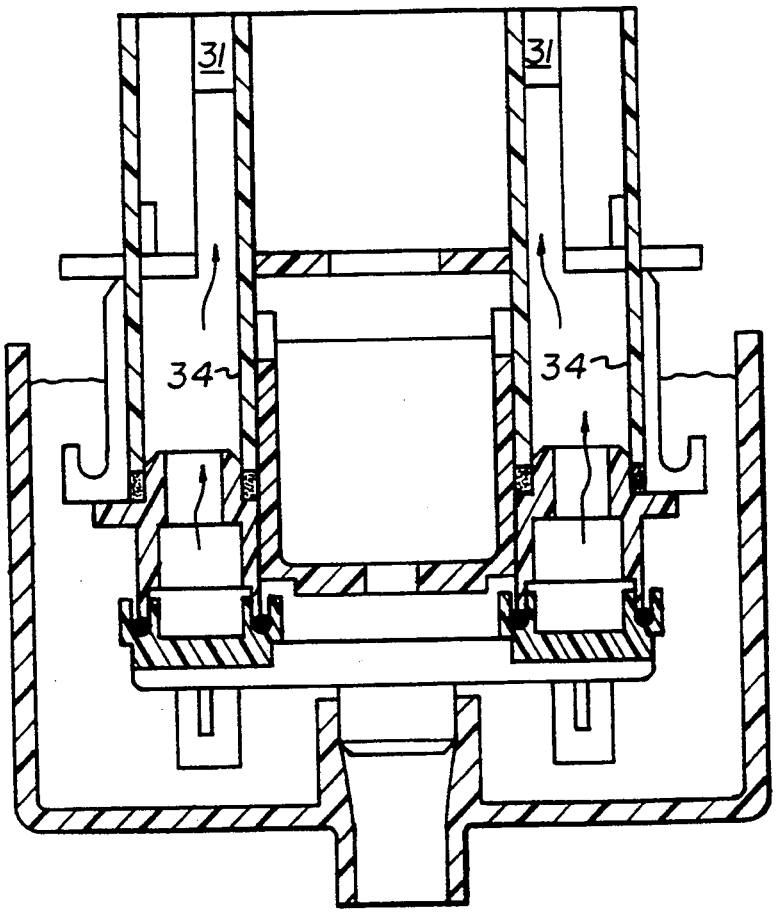
FIG. 5 is a cross-sectional view of the processing unit of FIG. 2 as taken along line 5—5 illustrating how the fluid passes from the lower tank to the upper tank.
Figure 6:
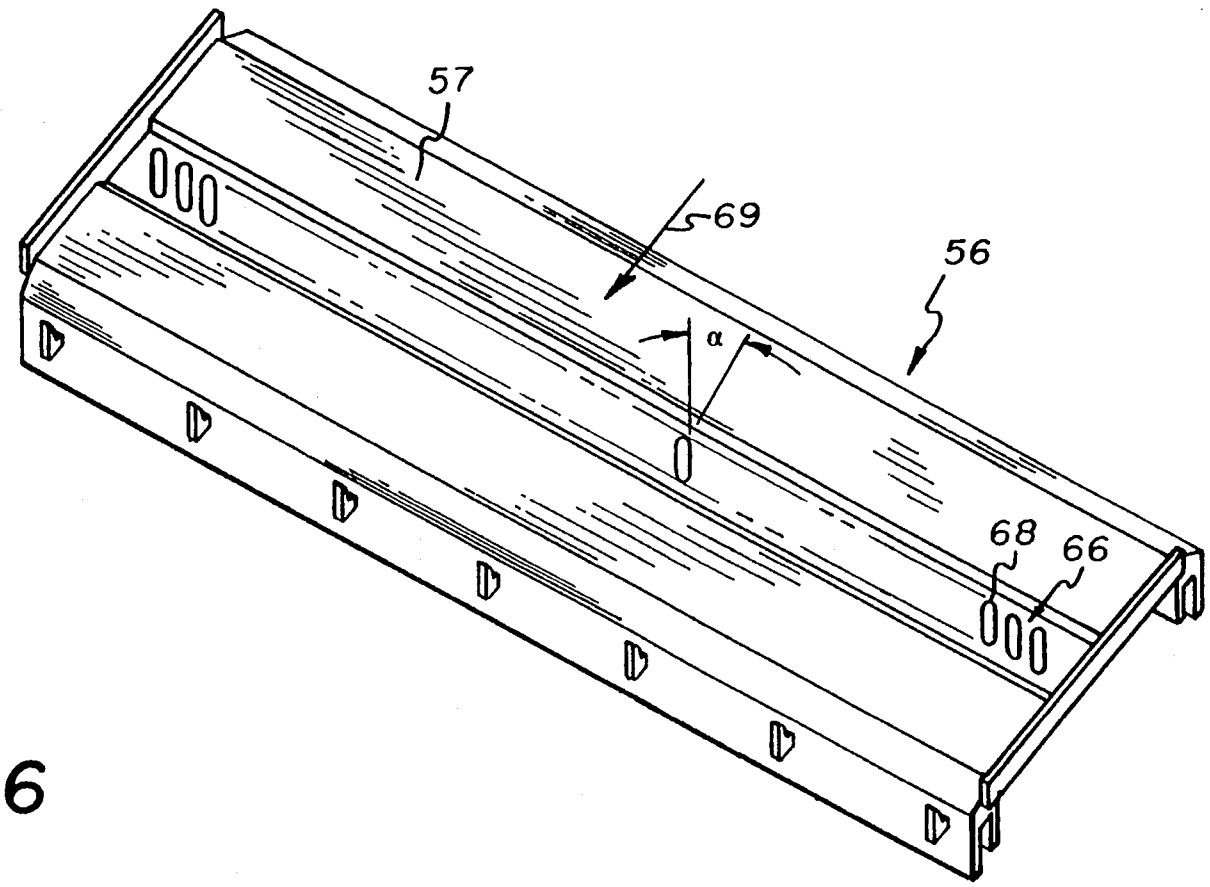
FIG. 6 is a perspective view of one of the inner nozzles illustrating one of the drains through which processing fluid returns to the sump tank for that particular processing unit.
Figure 7:
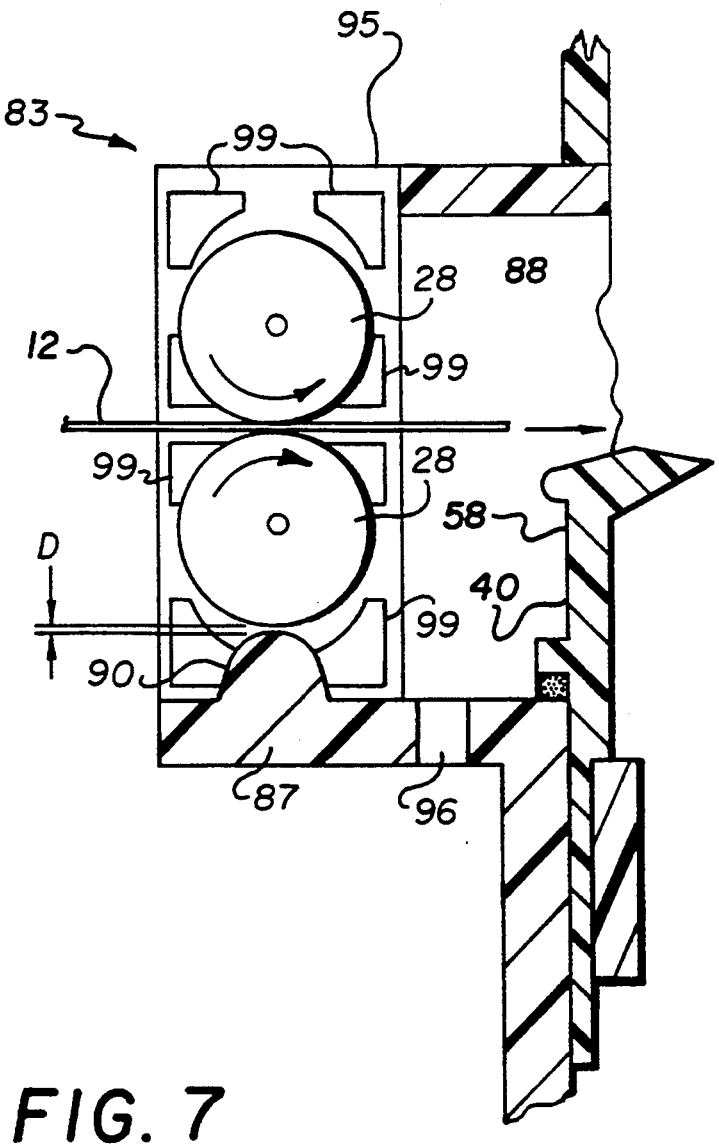
FIG. 7 is an enlarged cross-sectional view of the portion of the processor of FIG. 4 adjacent the nip roller.
Figure 8:
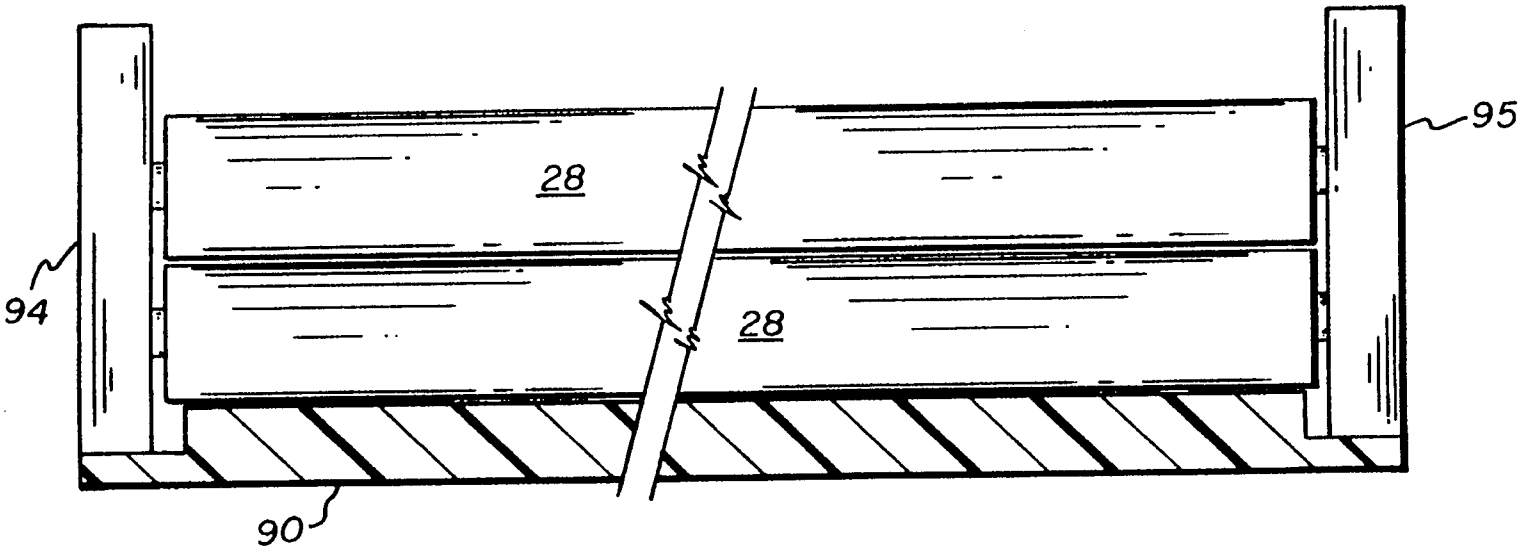
FIG. 8 is a cross-sectional view of the weir of FIG. 7 as taken along line 8—8.

FIG. 1 of the drawings illustrates a photographic processing apparatus made in accordance with the present invention, generally designated 10, that is useful for processing a strip or sheet of photosensitive material 12 (film, paper or other appropriate material). The photographic processing apparatus 10 includes a plurality of photographic processing units, three of which are shown at 14,16 and 18. A processing fluid 22 is supplied to each unit. The processing fluid 22 is generally in a liquid form and includes such photographic processing liquids as developer, fixer, bleach, rinsing fluid, water, or any other fluids for use in the processing of photosensitive material. Any number of photographic processing units can be included in the photographic process apparatus 10 depending upon the number of processing fluids required for processing a specific photosensitive material. The processor may of course include other elements typically found in processors. For example, a dryer 20 may be provided for drying of the photosensitive material. Additionally a processing unit made in accordance with the present invention may be combined with other conventional processing units as desired.

A plurality of sump tanks 23,25,27 for holding a processing fluid 22 are provided for units 14,16,18, respectively. The photosensitive material 12 is conveyed through the apparatus 10 by a plurality of nip rollers 28 associated with the photographic processing units 14,16,18. The rollers 28 can be driven by any conventional drive means (not shown).

The photographic processing units 16,18 are the same or similar in construction to the photographic processing unit 14. Therefore only processing unit 14 will be discussed in detail it being understood that the other processing units are similarly constructed. Referring to FIGS. 2-6 processing unit 14 comprises an upper tank 30 and a lower tank 32 having fluid retention chambers 31, 33, respectively, for holding processing fluid 22. Four connecting tubes 34 connect the retention chambers 31,33 of tanks 30 and 32 so as to allow processing fluid 22 to flow freely between the upper tank 30 and lower tank 32. The processing unit 14 further includes a processing section 36 located between the upper tank 30 and lower tank 32. The processing section 36 comprises an upper nozzle assembly 38 associated with the upper tank 30 and a lower nozzle assembly 40 associated with lower tank 32. The upper and lower nozzle assemblies 38,40 define a narrow fluid processing chamber 42 through which the photosensitive material 12 travels during processing. The chamber 42 has an entrance 44 through which the photosensitive material enters the chamber 42 and an exit 46 through which the photosensitive material leaves the chamber 42. The upper nozzle assembly 38 includes an inner nozzle 48 and a pair of outer nozzles 50 secured to upper tank 30. The inner and outer nozzles 48, 50 define a pair of passages 52 which are in fluid communication with the fluid retention chamber 31 of the upper tank 30 and a pair of discharge openings/outlets 53 which extends along substantially the entire length of the tank 30 for dispensing of the processing fluid 22 into chamber 42. The outlets 53 allows fluid 22 to enter chamber 42 and creates a first fluid layer on one side of the photosensitive material 12. The inner nozzle 48 includes a substantially flat central section 57 which forms the top of chamber 42.

The lower nozzle assembly 40 is similar to the upper nozzle assembly 38 in structure and operation except that it is associated with the lower tank 32. The lower nozzle assembly 38 includes an inner nozzle 56 secured to the top of tank 32 and a pair of outer nozzles 58 also secured to lower tank 32. The inner and outer nozzles 56,58 define a pair of passage 60 which are in fluid communication with the retention chamber 33 of the lower tank 32 and a pair of discharge openings/outlets 61 for dispensing of the fluid into chamber 42 so as to create a second fluid layer on the opposite side of the photosensitive material 12. The inner nozzle 56 comprises a substantially flat central section 59 which forms the bottom of chamber 42. The flat sections 57,59 of inner nozzles 48,56, respectively, form the narrow processing chamber 42. The flat sections are spaced apart such that the photosensitive material may easily pass through the chamber 42 and a thin fluid processing layer is formed on both sides of the photosensitive material 12. In the particular embodiment illustrated, the sections 57,59 are spaced apart a distance D is about 0.125 inches (0.3175 cms) and is designed to receive a film having a thickness of about 0.007 inches (0.0175 cms).

Processing fluid 22 is exhausted from chamber 42 by a pair of drains 66, 67 provided in inner nozzles 48,56. Preferably as illustrated the drains 66,67 are located substantially midway between the entrance 44 and exit 46. The drains 66,67 each comprise at least one opening provided in the substantially flat surfaces of inner nozzles 48,56. In the particular embodiment illustrated, drains 66,67 each comprise a plurality of aligned slots 68 disposed at an angle $\alpha$ with respect to the direction of fluid flow (as indicated by arrow 69 in FIG. 6) across the inner nozzles 48,56. However, the drains 66,67 may comprise any desired number of openings 68 having any desired configuration. Conduits or passageway 70 is formed between the inner nozzles 48 and tanks 30 for exhausting the fluid 22 from the chamber 42. The conduit 70 terminates in an outlets 76 for emptying the fluid to the sump tank 23. The processing fluid flowing through drain 67 directly to retaining area 77 and then flows to sump tank 23 through a pair of openings 79.

A pair of weirs 91 are provided adjacent the outlets 76, 78 for receiving the processing fluid. Each of the weirs 91 includes a wall having an upper edge 97 which is adjacent the outlet 76 and has a receiving chamber 84 into which the fluid 22 flows. The weirs 91 each have an opening 86 in the bottom for allowing fluid to return to the sump tank 23. In the particular embodiment illustrated the weirs 91 each have a substantially rectangular configuration and is sized such that the opening 86 is substantially always below the top of the fluid in sump tank 23. The size of opening 86 is such that the level of fluid 22 within weir 91 will be maintained is slightly below the upper edge 97.

A pump 51 is used to draw processing fluid from the sump tank 23 into the lower input 85 of the lower tank 32. The pump 51 causes the fluid 22 to go into the lower chamber 33, which in turn causes the processing fluid 22 to go into vertical tubes 34 so that processing fluid 22 will fill the upper tank 30 as best seen by reference to FIG. 5. This will cause fluid 22 to fill both the upper and lower tanks 30,32 such that substantially equal fluid pressure is applied to the outlets 53,61 at the entrance 44 and exit 46 of the chamber 42.

Means are provided for minimizing oxidation of the processing fluid caused by flow in the upper drain. In particular, referring to FIG. 4, there is provided a blanket 81 which is placed in the return drain 66 such that the blanket 81 lies on top of the processing fluid flowing therethrough. Preferably, as illustrated, the blanket 81 covers substantially the entire surface area of the drain 66 so as to minimize the amount of processing fluid that is exposed to the environment therein. The blanket 81 is made of a material that prevents the surrounding air/atmosphere from contacting the surface of the processing fluid within the drain. In the embodiment illustrated the blanket is made of a closed cellular foam material, and more particularly, blanket 81 is made of polypropylene.

Means are also provided for reducing the oxidation of the processing fluid at the entrance and exit of the processing chamber adjacent the nip rollers 28. In prior fluid suspension type processors, before any film is placed within the processing chamber, a small portion of the processing fluid flows toward nip rollers 28 at the entrance and exit. As the processing fluid engages the nip rollers 28, the processing fluid is placed into turbulent flow. This turbulent flow becomes more severe when film is passed through the processing chamber. In the present invention means are provided for eliminating and/or minimizing the amount of turbulent flow of the processing fluid at the entrance and exit adjacent the nip rollers 28. This is accomplished by providing weir 83 between the nip rollers 28 and the adjacent entrance 44 and exit 46. The weir 83 is designed to provide controlled non-turbulent flow of processing fluid in the area adjacent the nip rollers 28. The weirs 83 each comprise a bottom wall 87, a pair of side walls 88,89 extending between the adjacent tank and nip rollers 28, and a dam 90 disposed between the lower roller of the adjacent pair of nip rollers 28 and bottom wall 87. The dam 90 extends continuously between the side walls 88,89 so as control the flow of processing fluid from the weir 83 adjacent the nip rollers 28. The top edge 92 of the dam 90 is spaced a distance D from the adjacent roller 28. The distance D preferably ranges from about 0.0 inches to about 0.050 inches (0.127 cms). In the particular embodiment illustrated the distance D is about 0.025 inches (0.0635 cms). The weir 83 includes a pair of mounting brackets 94,95 which mount the nip rollers 28 to the lower tank. The weir 83 is provided with drain outlets to control the flow of processing fluid from the weir 83. The bottom wall 87 is provided with an opening 96 for allowing controlled flow of processing fluid when no film is passing through the processing chamber 42. The brackets 94,95 are provided with a plurality of openings 99 which allow the controlled flow of excess processing fluid when then film is passing through the processing chamber 42. The number and size of opening 96 is selected so that non turbulent flow occurs in this area when no photosensitive material is passing through the processor. The openings 99 are located such that the excess processing fluid leaves weir 83 in a non turbulent manner. The openings 99 are at a level and of a cross-sectional area such that excess Processing fluid will flow in a non turbulent manner therethrough when film is passing through the chamber. The openings 99 in upper portion of the brackets 94,95 are provided in the event additional overflow capacity is required. The number, size and location of openings 99 can be varied to meet the fluid dynamics of the processor.

A pair of small air vent openings 80 are provided in conduits 72 so as to allow processing fluid 22 to drain from conduits 72 when the pump 51 is turned off. The openings 80 are small enough so as not to interfere with the drain 67. In the particular embodiment illustrated, openings 80 each comprise a circular hole having a diameter of about 0.09375 inches (0.238 cms).

As is well known in the art, various other modifications may be made to the processing unit as is customary. For example, in the particular embodiment illustrated, a heat exchanger 98 is provided for cooling of the processing fluid. An optional heater 137 may also be provided for also heating of the processing fluid when necessary. While the drawings illustrate the pump 51 located outside of the sump tank 23, it could equally be located within the sump tank 23 if desired. Additionally, appropriate connections may be provided for connecting of the sump tank to the pump and to the lower tank 32 by suitable means.

The present invention is directed to an apparatus for processing photosensitive material which minimizes or eliminates turbulent flow of processing fluid.

The invention has been described in detail with particular reference to a preferred embodiment thereof, but it will be understood that variations and modifications can be made without departing from the scope of the present invention. The present invention being limited by the following claims.

We claim:

1. In an apparatus for processing photosensitive material, the apparatus having, a processing chamber, said chamber having an entrance and an exit for allowing a photosensitive material to travel through the processing chamber, first supply means for supplying processing fluid to the processing chamber to create a first fluid layer on one side of the photosensitive material, a first drain for removing processing fluid from the first fluid layer, second supply means for supplying processing fluid to the processing chamber to create a second fluid layer on the opposite side of the photosensitive material, a second drain for removing processing fluid from the second fluid layer, the first drain comprises a first duct having an inlet and outlet, the inlet of the first duct being connected to the first drain and the outlet of the first duct being fluidly connected to a sump tank, the improvement comprising:

means for minimizing oxidation of the processing solution, comprising a blanket placed in the first duct for covering the processing solution passing therethrough.

2. In an apparatus according to claim 1 wherein said blanket is made of a closed cellular material.

3. In, an apparatus according to claim 2 wherein said blanket is made of polypropylene.

4. In an apparatus for processing photosensitive material, the apparatus having, a processing chamber, said chamber having an entrance and an exit for allowing a photosensitive material to travel through the processing chamber, first supply means for supplying processing fluid to the processing chamber to create a first fluid layer on one side of the photosensitive material, a first drain for removing processing fluid from the first fluid layer, second supply means for supplying processing fluid to the processing chamber to create a second fluid layer on the opposite side of the photosensitive material, a second drain for removing processing fluid from the second fluid layer, the first drain comprises a first duct having an inlet and outlet, the inlet of the first duct being connected to the first drain and the outlet of the first duct being fluidly connected to a sump tank, the improvement comprising:

means for minimizing oxidation of the processing solution, and a pair of nip rollers disposed adjacent the exit and entrance, said means for minimizing oxidation comprising a weir formed between the nip rollers and the side of the adjacent tank, said weir being designed so as to prevent turbulent flow of processing solution adjacent thereto and having a) first means for regulating overflow of processing solution out the weir when no photosensitive material is passing through the nip rollers, said first means comprising an outlet in the bottom of the weir, and b) second means for regulating the overflow of processing solution when photosensitive material is being passed through the nip rollers.

5. In an apparatus for processing photosensitive material, the apparatus having, a process chamber, said chamber having an entrance and an exit for allowing a photosensitive material to travel through the processing chamber, first supply means for supplying processing fluid to the processing chamber to create a first fluid layer on one side of the photosensitive material, a first drain for removing processing fluid from the first fluid layer, second supply means for supplying processing fluid to the processing chamber to create a second fluid layer on the opposite side of the photosensitive material, a second drain for removing processing fluid from the second fluid layer, the first drain comprises a first duct having an inlet and outlet, the inlet of the first duct being connected to the first drain and the outlet of the first duct being fluidly connected to a sump tank, the improvement comprising:

means for minimizing oxidation of the processing solution, including a dam disposed below the bottom roller of said nip rollers.

6. In an apparatus according to claim 5 wherein said dam and said bottom roller are spaced a distance apart of about 0.025 inches (0.0635 cm).

7. In an apparatus for processing photosensitive material, the apparatus having an upper tank for retaining a processing fluid and a lower tank for retaining the processing fluid, a processing chamber located between the upper tank and lower tanks, said processing chamber having an entrance and an exit for allowing the photosensitive material to travel through the chamber, first supply means for supplying processing fluid from the upper tank to the processing chamber to create a first fluid layer on one side of the photosensitive material, a first drain located for removing processing fluid from the first fluid layer, second supply means for supplying processing fluid from the lower tank to the processing chamber to create a second fluid layer on the opposite side of the photosensitive material, a second drain for removing processing fluid from the second fluid layer, a pair of nip rollers located adjacent the entrance and exit for moving the photosensitive material through the chamber; the improvement comprising:

means located adjacent the nip rollers for minimizing oxidation of the processing solution, comprising, a weir formed between the nip rollers and the side of the adjacent tank designed so as to prevent turbulent flow of processing solution adjacent thereto, said weir having first means for regulating overflow of processing solution out the weirs when no photosensitive material is passing through the nip rollers.

8. In an apparatus according to claim 7 wherein said first means for regulating overflow of processing solution out of the weir comprises an outlet in the bottom of the weir.

9. In an apparatus according to claim 8 wherein said outlet is an circular opening having a diameter of about 0.31 inches (7.9 mm).

10. In an apparatus according to claim 7 wherein said weir is further provided with second means for regulating the over flow of processing solution when photosensitive material is being passed through the nip rollers.

11. In an apparatus according to claim 10 wherein said second means for regulating over flow of processing solution when photosensitive material is being passed through the nip rollers comprises at least one opening provided in the sides of each weir located that excess processing solution passes out the weir.

12. In an apparatus for processing photosensitive material, the apparatus having an upper tank for retaining a processing fluid and a lower tank for retaining the processing fluid, a processing chamber located between the upper tank and lower tanks, said processing chamber having an entrance and an exit for allowing the photosensitive material to travel through the chamber, first supply means for supplying processing fluid from the upper tank to the processing chamber to create a first fluid layer on one side of the photosensitive material, a first drain located for removing processing fluid from the first fluid layer, second supply means for supplying processing fluid from the lower tank to the processing chamber to create a second fluid layer on the opposite side of the photosensitive material, a second drain for removing processing fluid from the second fluid layer, a pair of nip rollers located adjacent the entrance and exit for removing the photosensitive material through the chamber; the improvement comprising:

means located adjacent the nip rollers for minimizing oxidation of the processing solution and a first duct having an inlet and outlet, the inlet of the first duct being connected to the first drain and the outlet of the first duct being fluidly connected to a sump tank.

13. In an apparatus according to claim 12 wherein said means of minimizing oxidation of the processing solution further comprises a blanket placed in the first duct for covering the processing solution passing therethrough.

14. In an apparatus according to claim 13 wherein said blanket is made of a closed cellular material.

15. In an apparatus according to claim 13 wherein said blanket is made of polypropylene.

16. In an apparatus for processing photosensitive material, a narrow processing chamber having an entrance and an exit for allowing the photosensitive material to travel through the chamber, means for supplying a pair of nip rollers located adjacent the entrance and exit for moving the photosensitive material through the chamber; the improvement comprising:

means located adjacent the nip rollers for minimizing oxidation of the processing solution and comprising a weir formed between the nip rollers and the entrance and/or exit of the processing chamber so as to prevent turbulent flow of processing solution adjacent thereto, said weir having first means for regulating overflow of processing solution out the weirs when no photosensitive material is passing through the nip rollers.

17. In an apparatus according to claim 16 wherein said first means for regulating overflow of processing solution out of the weir comprises an outlet in the bottom of the weir.

18. In an apparatus according to claim 17 wherein said outlet is a circular opening having a diameter of about 0.31 inches (7.9 mm).

19. In an apparatus according to claim 17 wherein said weir is further provided with second means for regulating the overflow of processing solution when photosensitive material is being passed through the nip rollers.

20. In an apparatus according to claim 19 wherein said second means for regulating overflow of processing solution when photosensitive material is being passed through the nip rollers comprises at least one opening provided in the sides of said weir located such that excess processing solution passes out the weir.

21. In an apparatus for processing photosensitive material, a narrow processing chamber having an entrance and an exit for allowing the photosensitive material to travel through the chamber, means for supplying a pair of nip rollers located adjacent the entrance and exit for moving the photosensitive material through the chamber; the improvement comprising:

means located adjacent the nip rollers for minimizing oxidation of the processing solution and comprising a weir formed between the nip rollers and the entrance and/or exit of the processing chamber so as to prevent turbulent flow of processing solution adjacent thereto, said weir including a dam disposed below the bottom roller of said nip rollers.

22. In an apparatus according to claim 21 wherein said dam and said bottom roller are spaced a distance apart of about 0.025 inches (0.0635 ) cms).

* * * * *